US007300259B2

(12) United States Patent
Cho et al.

(10) Patent No.: US 7,300,259 B2
(45) Date of Patent: Nov. 27, 2007

(54) VARIABLE CAPACITY ROTARY COMPRESSOR

(75) Inventors: Sung Hea Cho, Suwon (KR); Seung Kap Lee, Suwon (KR); Chun Mo Sung, Hwasung (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 480 days.

(21) Appl. No.: 10/846,538

(22) Filed: May 17, 2004

(65) Prior Publication Data

US 2005/0079071 A1 Apr. 14, 2005

(30) Foreign Application Priority Data

Oct. 14, 2003 (KR) ..... 10-2003-0071474

(51) Int. Cl.
*F04B 49/00* (2006.01)

(52) U.S. Cl. ..... 417/218; 417/221

(58) Field of Classification Search ..... 417/218, 417/221; 74/23, 55

See application file for complete search history.

(56) References Cited

U.S. PATENT DOCUMENTS 5,871,342 A 2/1999 Harte et al.

7,144,224 B2 * 12/2006 Kim et al. ..... 417/218

FOREIGN PATENT DOCUMENTS

JP 2005-23924 1/2005

OTHER PUBLICATIONS

U.S. Appl. No. 10/352,000, filed Jan. 28, 2003, Sung-Hea Cho, et al., Samsung Electronics Co., Ltd.
Office Action and related documents issued by the Japanese Patent Office (12 pages).

* cited by examiner

*Primary Examiner*—Anthony D. Stashick
*Assistant Examiner*—Peter J Bertheaud
(74) *Attorney, Agent, or Firm*—Staas & Halsey LLP

(57) ABSTRACT

A variable capacity rotary compressor, including upper and lower compression chambers having different capacities, a rotating shaft passing through the upper and lower compression chambers, upper and lower eccentric cams provided on the rotating shaft, and upper and lower eccentric bushes fitted over the upper and lower eccentric cams, respectively. A slot is provided at a predetermined position between the upper and lower eccentric bushes. A locking pin, moves along the slot, to change a position of the upper or lower eccentric bush to a maximum eccentric position, and a clutch engages with the slot at a position opposite to the locking pin to thereby preventing the upper and lower eccentric bushes from slipping over the upper and lower eccentric cams, respectively.

8 Claims, 8 Drawing Sheets

VARIABLE CAPACITY ROTARY COMPRESSOR

CROSS-REFERENCE TO RELATED APPLICATIONS

The application claims the benefit of Korean Patent Application No. 2003-71474, filed Oct. 14, 2003 in the Korean Intellectual Property Office, the disclosure of which is incorporated herein by reference.

BACKGROUND OF THE INVENTION

1. Field of the Invention

The present invention relates, in general, to rotary compressors and, more particularly, to a variable capacity rotary compressor in which a compression operation is executed in either of two compression chambers having different capacities, by an eccentric unit mounted to a rotating shaft.

2. Description of the Related Art

Generally, a compressor is installed in a refrigeration system, such as an air conditioner and a refrigerator, which operates to cool air in a given space using a refrigeration cycle. In the refrigeration system, the compressor compresses a refrigerant which circulates through a refrigeration circuit. A cooling capacity of the refrigeration system is determined according to a compression capacity of the compressor. Thus, when the compressor varies a compression capacity thereof as desired, the refrigeration system may be operated under an optimum condition based on several factors, including a difference between a practical temperature and a predetermined temperature, thus allowing air in a given space to be efficiently cooled, and saving energy.

A variety of compressors are used in the refrigeration system. The compressors are typically classified into two types, which are rotary compressors and reciprocating compressors. The present invention relates to the rotary compressor, which will be described in the following.

The conventional rotary compressor includes a hermetic casing, with a stator and a rotor being installed in the hermetic casing. A rotating shaft penetrates through the rotor. An eccentric cam is integrally provided on an outer surface of the rotating shaft. A roller is provided in a compression chamber to be rotated over the eccentric cam.

The rotary compressor constructed as described above is operated as follows. As the rotating shaft rotates, the eccentric cam and the roller execute eccentric rotation in the compression chamber. At the time, a gas refrigerant is drawn into the compression chamber and then compressed, prior to discharging the compressed refrigerant to an outside of the hermetic casing.

However, the conventional rotary compressor has a problem in that the rotary compressor is fixed in a compression capacity thereof, so that it is impossible to vary the compression capacity according to a difference between an environmental temperature and a preset reference temperature.

In a detailed description, when the environmental temperature is considerably higher than the preset reference temperature, the compressor must be operated in a large capacity compression mode to rapidly lower the environmental temperature. Meanwhile, when the difference between the environmental temperature and the preset reference temperature is not large, the compressor must be operated in a small capacity compression mode so as to save energy. However, it is impossible to change the capacity of the rotary compressor according to the difference between the environmental temperature and the preset reference temperature, so that the conventional rotary compressor does not efficiently cope with a variance in temperature, thus leading to a waste of energy.

SUMMARY OF THE INVENTION

Accordingly, an aspect of the present invention is to provide a variable capacity rotary compressor which is constructed so that a compression operation is executed in either of two compression chambers having different capacities by an eccentric unit mounted to a rotating shaft, thus varying a compression capacity as desired.

Other aspect of the present invention is to provide a variable capacity rotary compressor, which prevents an eccentric bush from rotating at a speed faster than a rotating shaft in a specific range, due to variance in pressure of a compression chamber as the rotating shaft rotates.

A further aspect of the invention is to provides a variable capacity rotary compressor, which prevents noise from being generated due the slippage between and the collision of the locking pin and the first and second eccentric bushes.

Additional aspects and/or advantages of the invention will be set forth in part in the description which follows and, in part, will be obvious from the description, or may be learned by practice of the invention.

The above and/or other aspects are achieved by providing a variable capacity rotary compressor, including upper and lower compression chambers, a rotating shaft, upper and lower eccentric cams, upper and lower eccentric bushes, a slot, a locking pin, and a clutch unit. The upper and lower compression chambers have different capacities. The rotating shaft passes through the upper and lower compression chambers. The upper and lower eccentric cams are provided on the rotating shaft. The upper and lower eccentric bushes are fitted over the upper and lower eccentric cams, respectively. The slot is provided at a predetermined position between the upper and lower eccentric bushes. The locking pin moves along the slot to change a position of the upper or lower eccentric bush to a maximum eccentric position. The clutch unit engages with the slot at a position opposite to the locking pin, thus preventing the upper and lower eccentric bushes from slipping over the upper and lower eccentric cams, respectively.

The rotating shaft may include a through hole which is provided at a height corresponding to the slot, thus allowing the locking pin and the clutch unit to be placed in first and second ends of the through hole, respectively.

The clutch unit may include a clutch pin which is set in the second end of the through hole to reciprocate in a radial direction of the rotating shaft, and an elastic member which is provided in the through hole and elastically biases the clutch pin so that the clutch pin retracts into the through hole when the rotating shaft stops rotating.

The clutch pin may include a body part which has a diameter that is larger than a width of the slot, a locking part which is projected from an outside end of the body part and has a diameter that is smaller than the width of the slot, and a first threaded part which is projected from an inside end of the body part.

The locking pin may include a head which engages with the slot, and a threaded shank which extends from the head and has a second threaded part and a third threaded part. The second threaded part may be mounted to the first end of the through hole through a screw-type fastening method, thus mounting the locking pin to the through hole. The third threaded part may be projected from an inside end of the second threaded part.

The elastic member may be a coil spring. The coil spring may be set in the through hole to be coupled at first and second ends of the coil spring to the first threaded part of the clutch pin and the third threaded part of the locking pin, respectively.

The head of the locking pin and the locking part of the clutch pin respectively may include a tightening slot to allow the first and second ends of the coil spring to be easily coupled to the first threaded part of the clutch pin and the third threaded part of the locking pin, respectively.

The clutch pin and the coil spring may be installed in the second end of the through hole after the first end of the coil spring may be coupled to the first threaded part of the clutch pin, and the locking pin may be installed in the first end of the through hole by mounting the second threaded part of the threaded shank of the locking pin to the first end of the through hole using the tightening slot of the locking pin. Subsequently, the clutch pin may be tightened into the second end of the through hole using the tightening slot of the clutch pin, thus coupling the third threaded part of the locking pin to the second end of the coil spring, and thereby allowing the clutch pin to be set in the through hole to reciprocate in the radial direction of the rotating shaft by a centrifugal force of the rotating shaft and an elastic force of the coil spring.

BRIEF DESCRIPTION OF THE DRAWINGS

These and/or other aspects and advantages of the invention will become apparent and more readily appreciated from the following description of the embodiments of the invention, taken in conjunction with the accompanying drawings of which.

DETAILED DESCRIPTION OF THE PREFERRED EMBODIMENTS

Figure 1:
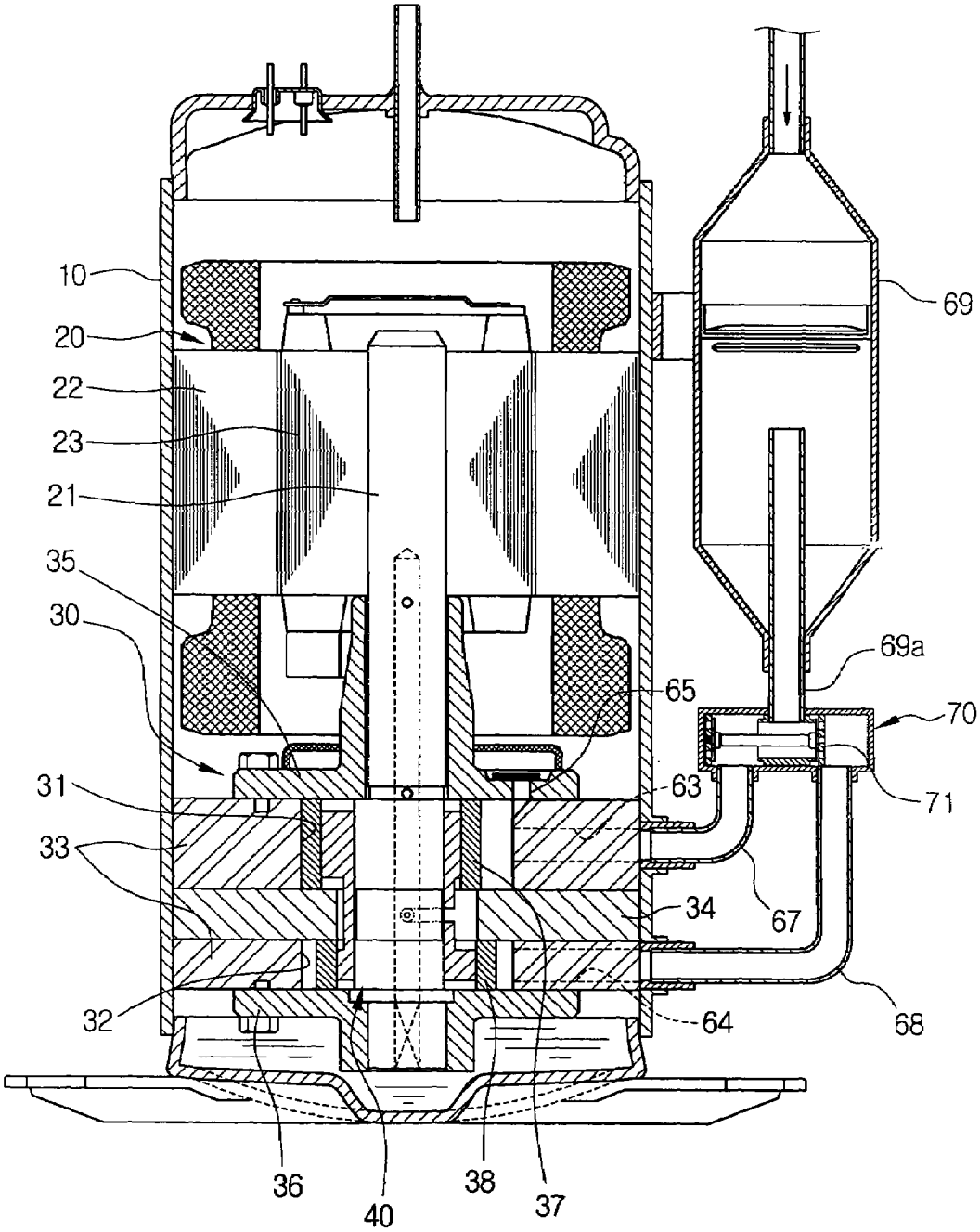
FIG. 1 is a sectional view to illustrate an interior construction of a variable capacity rotary compressor, according to an embodiment of the present invention.

Reference will now be made in detail to the present preferred embodiments of the present invention, examples of which are illustrated in the accompanying drawings, wherein like reference numerals refer to like elements throughout. The embodiment is described below in order to explain the present invention by referring to the figures.

An example of a variable capacity rotary compressor is explained in U.S. patent application Ser. No. 10/352,000, the content of which is incorporated herein by reference. Before presenting a detailed description of the present invention, the variable capacity rotary compressor is briefly discussed.

The construction of the variable capacity rotary compressor is as follows. The compressor includes first and second compression chambers. An eccentric unit is installed in the first and second compression chambers to execute the compression operation in either of the first and second compression chambers, according to a rotating direction of a rotating shaft. The eccentric unit includes first and second eccentric cams, first and second eccentric bushes, first and second rollers, and a locking pin. The first and second eccentric cams are provided on an outer surface of the rotating shaft which passes through the first and second compression chambers. The first and second eccentric bushes are rotatably fitted over the first and second eccentric cams, respectively. The first and second rollers are rotatably fitted over the first and second eccentric bushes, respectively, to compress a gas refrigerant. The locking pin is installed to change a position of one of the first and second eccentric bushes to a position eccentric from a central axis of the rotating shaft, while changing a position of a remaining one of the first and second eccentric bushes to a position concentric with the central axis of the rotating shaft, according to the rotating direction of the rotating shaft.

Thus, when the rotating shaft rotates in a forward or reverse direction, the compression operation is executed in either of the first and second compression chambers having different capacities by the eccentric unit constructed as described above, thus varying the compression capacity of the compressor as desired.

A detailed description of the present invention is now presented.

FIG. 1 is a sectional view to illustrate a variable capacity rotary compressor, according to an embodiment of the present invention. As shown in FIG. 1, the variable capacity rotary compressor includes a hermetic casing 10, with a driving unit 20 and a compressing unit 30 being installed in the hermetic casing 10. The driving unit 20 generates a rotating force, and the compressing unit 30 compresses gas using the rotating force of the driving unit 20. The driving unit 20 includes a cylindrical stator 22, a rotor 23, and a rotating shaft 21. The stator 22 is fixedly mounted to an inner surface of the hermetic casing 10. The rotor 23 is rotatably installed in the stator 22. The rotating shaft 21 is installed to pass through a center of the rotor 23, and rotates along with the rotor 23 in a first direction which is counterclockwise in the drawings or in a second direction which is clockwise in the drawings.

The compressing unit 30 includes a housing 33, upper and lower flanges 35 and 36, and a partition plate 34. The housing 33 defines upper and lower compression chambers 31 and 32, which are both cylindrical but have different capacities, therein. The upper and lower flanges 35 and 36 are mounted to upper and lower ends of the housing 33, respectively, to rotatably support the rotating shaft 21. The partition plate 34 is interposed between the upper and lower compression chambers 31 and 32 to partition the upper and lower compression chambers 31 and 32 from each other.

The upper compression chamber 31 is taller than the lower compression chamber 32, thus the upper compression chamber 31 has a larger capacity than the lower compression chamber 32. Therefore, a larger amount of gas is compressed in the upper compression chamber 31 in comparison with the lower compression chamber 32, thus allowing the rotary compressor to have a variable capacity.

When the lower compression chamber 32 is taller than the upper compression chamber 31, the lower compression chamber 32 has a larger capacity than the upper compression chamber 31, thus allowing a larger amount of gas to be compressed in the lower compression chamber 32.

Further, an eccentric unit 40 is placed in the upper and lower compression chambers 31 and 32 to execute a compressing operation in either the upper or lower compression chamber 31 and 32, according to a rotating direction of the rotating shaft 21. According to the present invention, a clutch 80 is provided at a predetermined position of the eccentric unit 40 to allow the eccentric unit 40 to operate smoothly and without slippage. The construction and operation of the eccentric unit 40 and the clutch 80 will be described later herein, with reference to FIGS. 2 to 8.

Upper and lower rollers 37 and 38 are placed in the upper and lower compression chambers 31 and 32, respectively, to be rotatably fitted over the eccentric unit 40. Upper inlet and outlet ports 63 and 65 (refer to FIG. 3) are formed at predetermined positions of the housing 33 to communicate with the upper compression chamber 31. Lower inlet and outlet ports 64 and 66 (refer to FIG. 6) are formed at predetermined positions of the housing 33 to communicate with the lower compression chamber 32.

Figure 3:
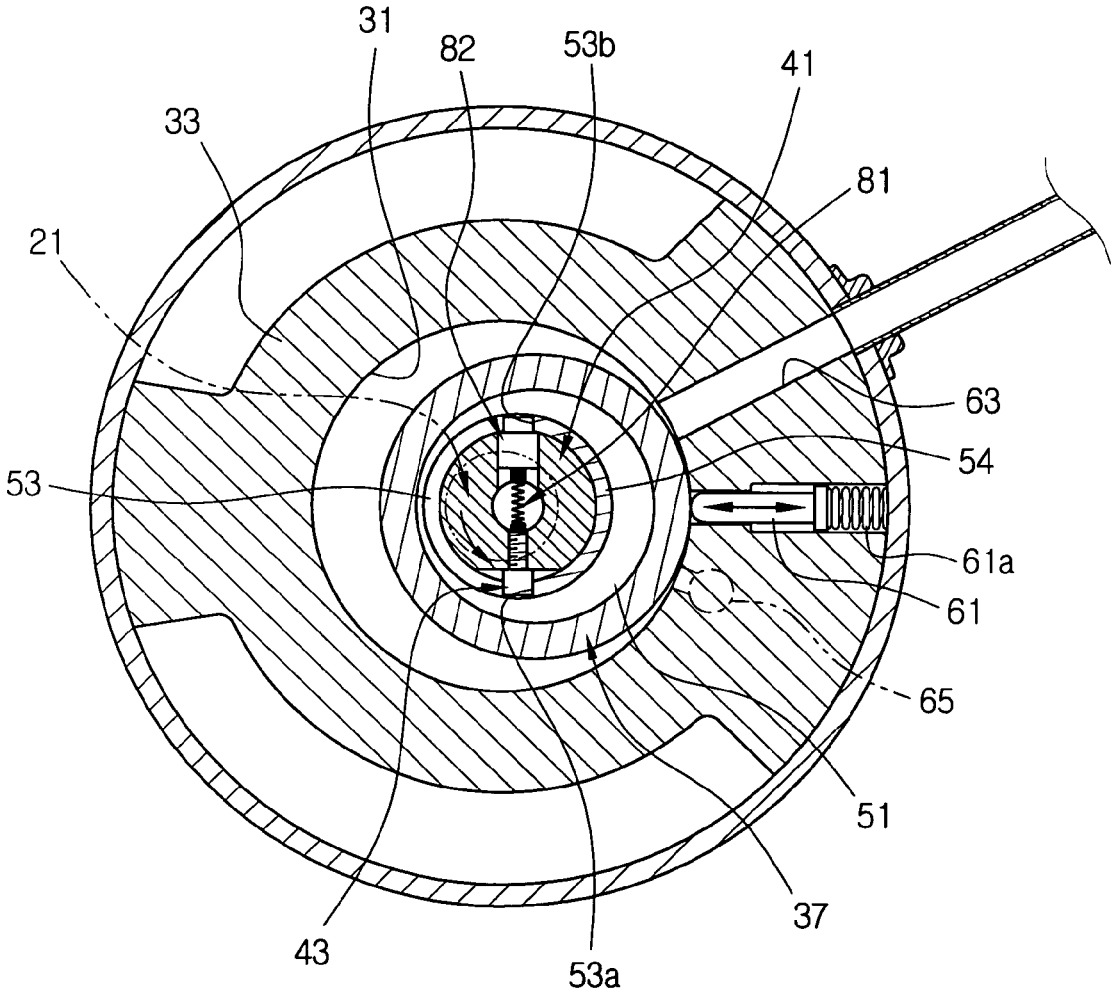
FIG. 3 is a sectional view to illustrate an upper compression chamber where a compression operation is executed by the eccentric unit of FIG. 2, when the rotating shaft rotates in a first direction.

An upper vane 61 is positioned between the upper inlet and outlet ports 63 and 65, and is biased in a radial direction by an upper support elastic member 61*a* (such as a support spring) to be in close contact with the upper roller 37 (refer to FIG. 3). Further, a lower vane 62 is positioned between the lower inlet and outlet ports 64 and 66, and is biased in a radial direction by a lower support elastic member 62*a* (such as a support spring) to be in close contact with the lower roller 38 (refer to FIG. 6).

Further, a refrigerant outlet pipe 69*a* extends from an accumulator 69 which contains a refrigerant therein. Of the refrigerant contained in the accumulator 69, only a gas refrigerant flows into the compressor through the refrigerant outlet pipe 69*a*. A path controller 70 is installed at a predetermined position of the refrigerant outlet pipe 69*a*. The path controller 70 opens an intake path 67 or 68, to supply the gas refrigerant to the upper or lower inlet port 63 or 64 of the upper or lower compression chamber 31 or 32 in which a compression operation is executed. A valve 71 is installed in the path controller 70 to move in a horizontal direction. The valve 71 functions to open either the intake paths 67 or 68 by a pressure differential between the intake path 67 connected to the upper inlet port 63 and the intake path 68 connected to the lower inlet port 64, to supply the gas refrigerant to the upper inlet port 63 or lower inlet port 64.

The construction of the eccentric unit 40 and the clutch 80 according to an embodiment of the present invention will be described in the following with reference to FIG. 2.

Figure 2:
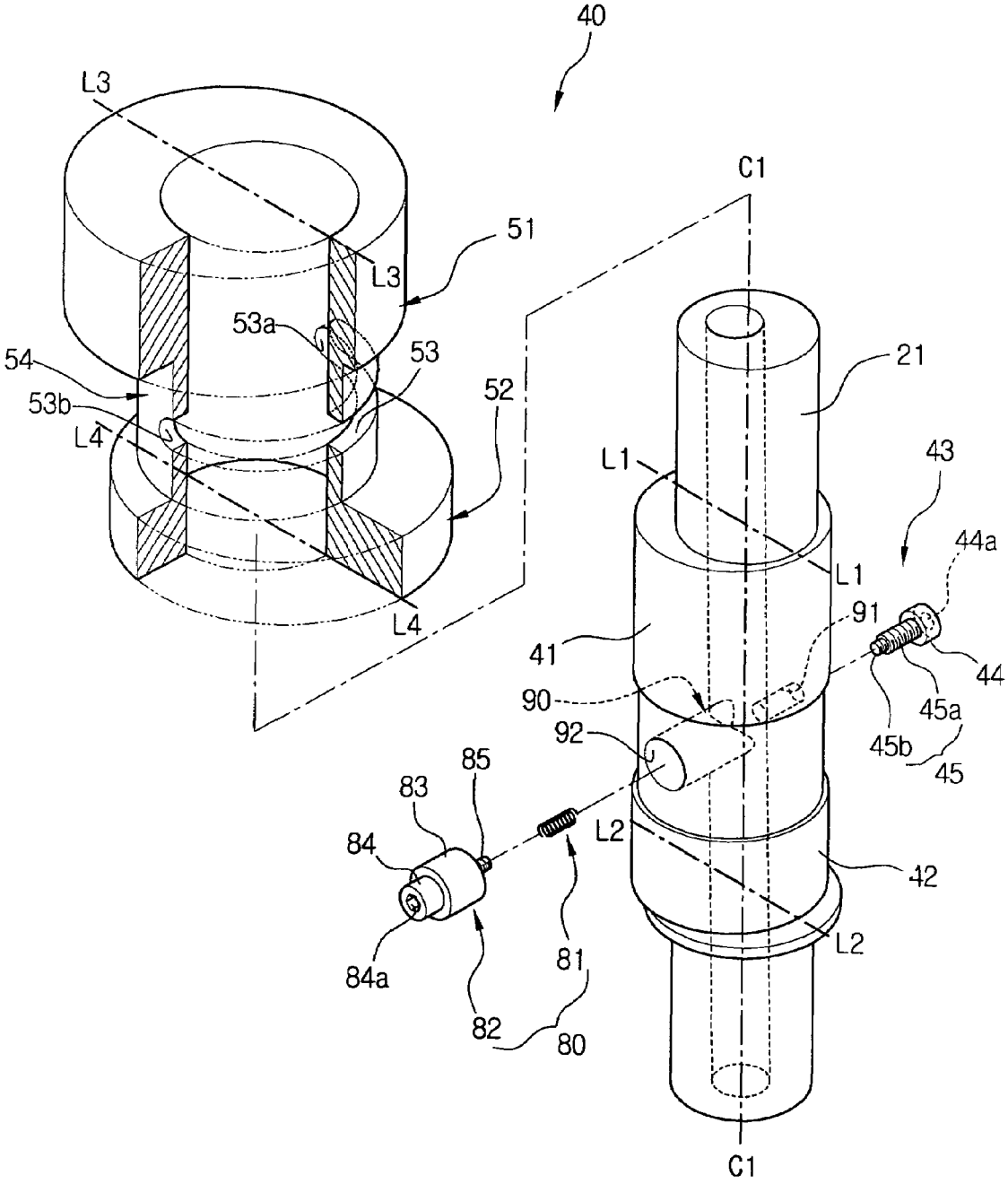
FIG. 2 is a perspective view of an eccentric unit included in the compressor of FIG. 1, in which upper and lower eccentric bushes of the eccentric unit are separated from a rotating shaft.

FIG. 2 is a perspective view of the eccentric unit 40 included in the compressor of FIG. 1, in which the upper and lower eccentric bushes 51 and 52 of the eccentric unit 40 are separated from the rotating shaft 21. As shown in FIG. 2, the eccentric unit 40 includes upper and lower eccentric cams 41 and 42. The upper and lower eccentric cams 41 and 42 are provided on the rotating shaft 21 to be located in the upper and lower compression chambers 31 and 32, respectively. Upper and lower eccentric bushes 51 and 52 are fitted over the upper and lower eccentric cams 41 and 42, respectively. A locking pin 43 is provided at a predetermined position between the upper and lower eccentric cams 41 and 42. A slot 53 of a predetermined length is provided at a predetermined position between the upper and lower eccentric bushes 51 and 52 to engage with the locking pin 43. The eccentric unit 40 also includes the clutch 80. The clutch 80 functions to prevent the upper or lower eccentric bush 51 or 52 from slipping over the upper or lower eccentric cam 41 or 42 at a predetermined position.

The upper and lower eccentric cams 41 and 42 are integrally provided on the rotating shaft 21 to be eccentric from the central axis C1-C1 of the rotating shaft 21. The upper and lower eccentric cams 41 and 42 are positioned to correspond to upper eccentric line L1-L1 of the upper eccentric cam 41 to a lower eccentric line L2-L2 of the lower eccentric cam 42. In this case, the upper eccentric line L1-L1 is defined as a line to connect a maximum eccentric part of the upper eccentric cam 41, which is maximally projected from the rotating shaft 21, to a minimum eccentric part of the upper eccentric cam 41, which is minimally projected from the rotating shaft 21. Meanwhile, the lower eccentric line L2-L2 is defined as a line to connect a maximum eccentric part of the lower eccentric cam 42, which is maximally projected from the rotating shaft 21, to a minimum eccentric part of the lower eccentric cam 42, which is minimally projected from the rotating shaft 21.

A through hole 90 is formed through the rotating shaft 21 in a transverse direction at a position between the upper and lower eccentric cams 41 and 42 to allow the locking pin 43 and the clutch 80 to be installed in the through hole 90. The through hole 90 is formed to be separated by an angle of about 90° with the upper and lower eccentric lines L1-L1 and L2-L2.

The upper and lower eccentric bushes 51 and 52 are integrated with each other by a connecting part 54 which connects the upper and lower eccentric bushes 51 and 52 to each other. The slot 53 is formed around a part of the connecting part 54, and has a length which is long enough to allow, an angle between a first line, extending from a first end 53*a* of the slot 53 to a center of the rotating shaft 21, and a second line, extending from a second end 53*b* of the slot 53 to the center of the rotating shaft 21, to be 180°.

When the upper and lower eccentric bushes 51 and 52 are fitted over the rotating shaft 21, the slot 53, which is provided between the upper and lower eccentric bushes 51 and 52, communicates with the through hole 90, which is provided on the rotating shaft 21. Thus, the locking pin 43 and the clutch 80 engage with the slot 53, to allow the upper and lower eccentric bushes 51 and 52 to rotate at a same speed as the rotating shaft 21.

The locking pin 43 includes a head 44 and a threaded shank 45. The head 44 has a slightly smaller diameter than a width of the slot 53 to engage with the slot 53. The threaded shank 45 extends from an inside end of the head 44, and has a smaller diameter than the diameter of the head 44. The threaded shank 45 includes a second thread 45*a* and a third thread 45*b* (a first thread will be described later herein).

The third thread 45*b* extends from the second thread 45*a*, and has a smaller diameter than the second thread 45*a*.

The threaded shank 45 of the locking pin 43 is tightened into a first end 91 of the through hole 90, which has an internal thread. A polygonal tightening slot 44*a* is formed on the head 44 of the locking pin 43, to allow a user to easily tighten the locking pin 43 into the first end 91 of the through hole 90. Thus, when the locking pin 43 is tightened using the tightening slot 44*a*, the second thread 45*a* of the threaded shank 45 is fastened to the first end 91 of the through hole 90. At this time, the locking pin 43 is set in the through hole 90 while the head 44 of the locking pin 43 being projected out of the through hole 90.

The clutch 80 includes a clutch pin 82 and a coil spring 81. The clutch pin 82 engages with the slot 53 to prevent the upper and lower eccentric bushes 51 and 52 from slipping. The coil spring 81 functions as an elastic member which normally biases the clutch pin 82 in a direction, so that the clutch pin 82 retracts into the through hole 90 when the rotating shaft 21 does not rotate and is projected out of the through hole 90 when the rotating shaft 21 rotates.

The clutch pin 82 includes a body part 83, a locking part 84, and the first thread 85. The body part 83 has a larger diameter than the width of the slot 53 to prevent the clutch pin 82 from being removed from the slot 53. The locking part 84 is projected from an outside end of the body part 83, and has a smaller diameter than the width of the slot 53 to engage with the slot 53. The first thread 85 is projected from an inside end of the body part 83, with a first end of the coil spring 81 coupled to the first thread 85.

An inner diameter of the coil spring 81 is equal to both a diameter of the first thread 85 of the clutch pin 82 and a diameter of the third thread 45*b* of the locking pin 43. The coil spring 81 is coupled at a second end thereof to the third thread 45*b* to be mounted to the threaded shank 45 of the locking pin 43. Further, the coil spring 81 is coupled at the first end thereof to the first thread 85 of the clutch pin 82, to allow the clutch pin 82 to be set in the through hole 90 to reciprocate in the radial direction of the rotating shaft 21. A polygonal tightening slot 84*a* is formed on the locking part 84 of the clutch pin 82, to allow the clutch pin 82 to be coupled to the coil spring 81.

The clutch pin 82, the coil spring 81, and the locking pin 43 are installed in the through hole 90 according to the following operations. First, the coil spring 81 and the clutch pin 82 are placed such that the coil spring 81 is aligned with the first thread 85 of the clutch pin 82, and then the clutch pin 82 is turned. In this case, the coil spring 81 is coupled at the first end thereof to the first thread 85 of the clutch pin 82.

In the above state, when the coil spring 81 is inserted in the through hole 90 through the second end 92, the coil spring 81 and the clutch pin 82 are set in the through hole 90.

Next, the upper and lower eccentric bushes 51 and 52 are fitted over the rotating shaft 21 so that the through hole 90 and the slot 53 are placed at a same height, and then the locking pin 43 is mounted to the first end 91 of the through hole 90 through the slot 53. At this time, by manipulating the tightening slot 44*a* which is provided on the head 44 of the locking pin 43 using an appropriate tool, such as a wrench, the locking pin 43 is turned while the second thread 45*a* of the locking pin 43 engages with the internal thread which is formed on an inner surface of the first end 91 of the through hole 90, to allow the locking pin 43 to be mounted to the through hole 90.

Figure 5:
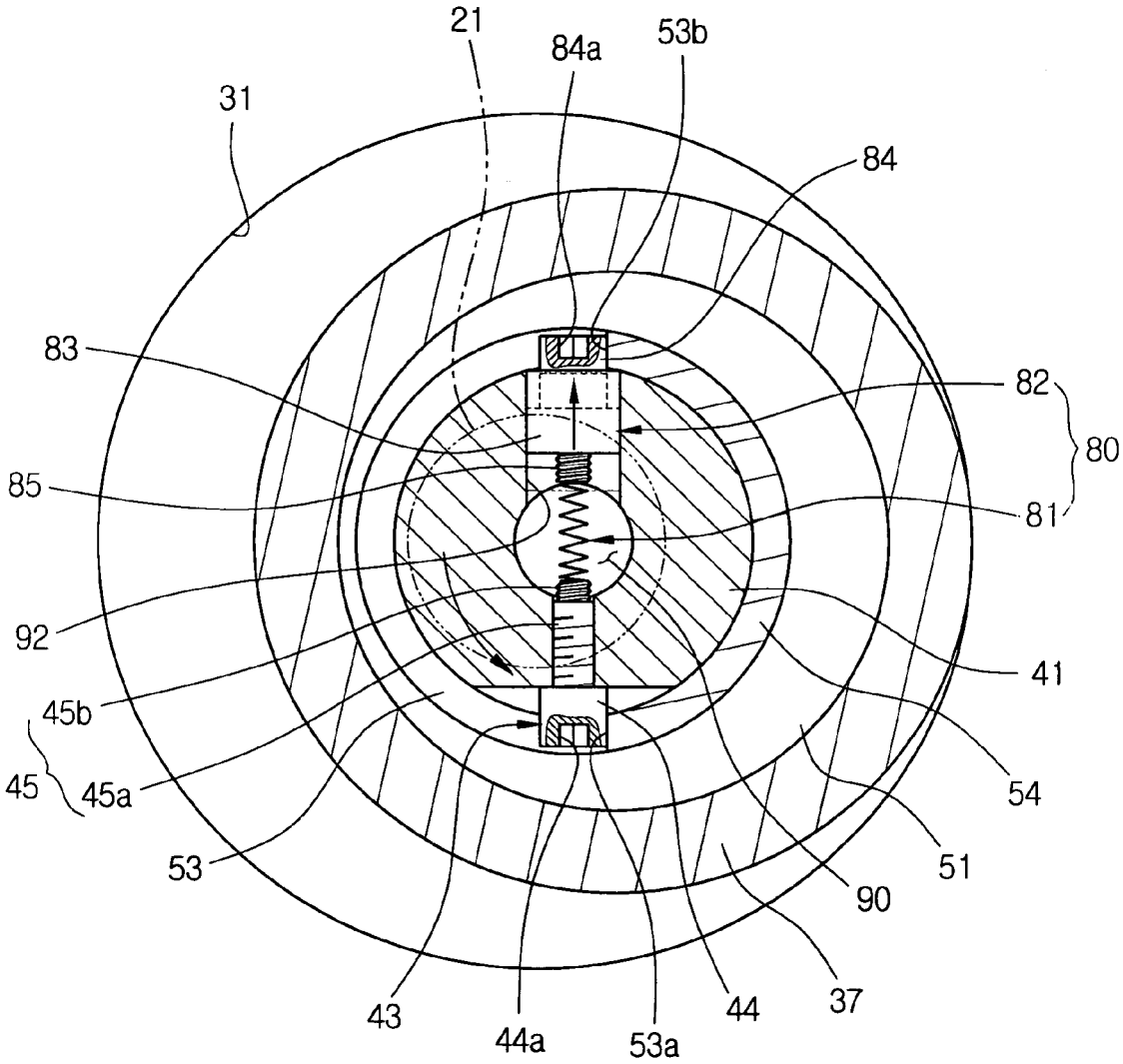
FIG. 5 is a sectional view to illustrate the upper eccentric bush which rotates without slippage by a clutch unit provided at a predetermined position of the eccentric unit of FIG. 2, when the rotating shaft rotates in the first direction.

Thereafter, by manipulating the tightening slot 84*a* which is provided on the locking part 84 of the clutch pin 82 using the appropriate tool, such as the wrench, the clutch pin 82 is turned while the coil spring 81 being coupled at the second end thereof to the third thread 45*b* of the locking pin 43, to allow the coil spring 81 to be coupled to the locking pin 43 (refer to FIG. 5).

As such, because the clutch 80 is set in the through hole 90 and then coupled to the locking pin 43, the clutch pin 82 is outwardly projected from the second end 92 of the through hole 90 by a centrifugal force generated when the rotating shaft 21 rotates, or the clutch pin 82 retracts into the through hole 90 by an elastic force of the coil spring 81 when the rotating shaft 21 stops rotating, to thereby prevent the upper and lower eccentric bushes 51 and 52 from slipping.

An eccentric line L3-L3, which connects the maximum eccentric part of the upper eccentric bush 51 to the minimum eccentric part thereof, is placed at about 90° with a line which connects the first end 53*a* of the slot 53 to a center of the connecting part 54. Meanwhile, an eccentric line L4-L4, which connects the maximum eccentric part of the lower eccentric bush 52 to the minimum eccentric part thereof, is placed at about 90° with a line which connects the second end 53*b* of the slot 53 to the center of the connecting part 54.

Further, the eccentric line L3-L3 of the upper eccentric bush 51 and the eccentric line L4-L4 of the lower eccentric bush 52 are positioned on a same plane, but the maximum eccentric part of the upper eccentric bush 51 is arranged to be opposite to the maximum eccentric part of the lower eccentric bush 52.

When the locking pin 43 is locked by the first end 53*a* of the slot 53 and the upper eccentric bush 51 rotates along with the rotating shaft 21 in the first direction (of course, the lower eccentric bush 52 also rotates), the maximum eccentric part of the upper eccentric cam 41 contacts the maximum eccentric part of the upper eccentric bush 51. Thus, the upper eccentric bush 51 rotates along with the rotating shaft 21 in the first direction while being maximally eccentric from the rotating shaft 21 (refer to FIG. 3). Meanwhile, in the case of the lower eccentric bush 52, the maximum eccentric part of the lower eccentric cam 42 contacts the minimum eccentric part of the lower eccentric bush 52. Thus, the lower eccentric bush 52 rotates along with the rotating shaft 21 in the first direction while being concentric with the rotating shaft 21 (refer to FIG. 4). At this time, the locking part 84 of the clutch pin 82 is outwardly projected by the centrifugal force of the rotating shaft 21 to engage with the second end 53*b* of the slot 53. Thus, the clutch pin 82 rotates while the locking part 84 thereof engaging with the second end 53*b* of the slot 53.

Conversely, when the locking pin 43 is locked by the second end 53*b* of the slot 53 and the lower eccentric bush 52 rotates along with the rotating shaft 21 in the second direction, the maximum eccentric part of the lower eccentric cam 42 contacts the maximum eccentric part of the lower eccentric bush 52. Thus, the lower eccentric bush 51 rotates along with the rotating shaft 21 in the second direction while being maximally eccentric from the rotating shaft 21 (refer to FIG. 6). Meanwhile, in the case of the upper eccentric bush 51, the maximum eccentric part of the upper eccentric cam 41 contacts the minimum eccentric part of the upper eccentric bush 51. Thus, the upper eccentric bush 51 rotates along with the rotating shaft 21 in the second direction while being concentric with the rotating shaft 21 (refer to FIG. 7). At this time, the locking part 84 of the clutch pin 82 is outwardly projected by the centrifugal force of the rotating shaft 21 to engage with the first end 53*a* of the slot 53. Thus, the clutch pin 82 rotates while the locking part 84 thereof engaging with the first end 53*a* of the slot 53.

The operation of compressing a gas refrigerant in the upper or lower compression chamber 31 or 32 by the eccentric unit 40 according to an embodiment of the present invention will be described in the following with reference to FIGS. 3 to 8.

Figure 4:
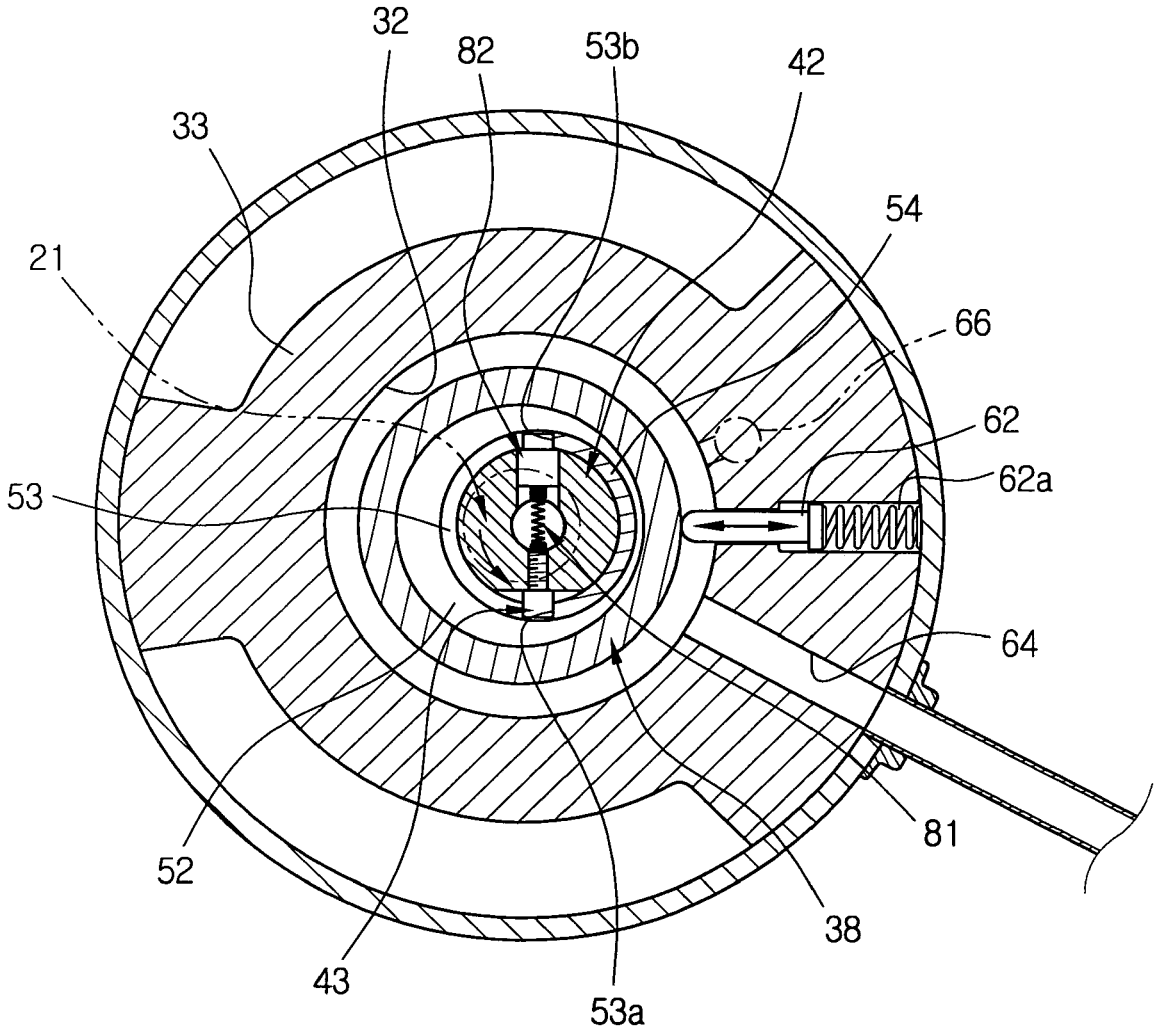
FIG. 4 is a sectional view, corresponding to FIG. 3, to illustrate a lower compression chamber where an idle operation is executed by the eccentric unit of FIG. 2, when the rotating shaft rotates in the first direction.

FIG. 3 is a sectional view to illustrate the upper compression chamber where the compression operation is executed without slippage by the eccentric unit of FIG. 2, when the rotating shaft rotates in the first direction. FIG. 4 is a sectional view, corresponding to FIG. 3, to illustrate the lower compression chamber where the idle operation is executed by the eccentric unit of FIG. 2, when the rotating shaft rotates in the first direction. FIG. 5 is a sectional view to illustrate the upper eccentric bush which rotates without slippage by the clutch of FIG. 2, when the rotating shaft rotates in the first direction.

As shown in FIG. 3, when the rotating shaft 21 rotates in the first direction which is counterclockwise in FIG. 3, the locking pin 43 projected from the rotating shaft 21 rotates at a predetermined angle while engaging with the slot 53 which is provided at a predetermined position between the upper and lower eccentric bushes 51 and 52. When the locking pin 43 rotates at the predetermined angle, and is locked by the first end 53*a* of the slot 53, the upper eccentric bush 51 rotates along with the rotating shaft 21. At this time, since the lower eccentric bush 52 is integrally connected to the upper eccentric bush 51 by the connecting part 54, the lower eccentric bush 52 also rotates along with the upper eccentric bush 51.

As such, when the rotating shaft 21 rotates at a low speed to change the position of the locking pin 43 between the first and second ends 53*a* and 53*b* of the slot 53, the locking part 84 of the clutch pin 82 retracts into the through hole 90 by the elastic force of the coil spring 81, to allow the rotating shaft 21 to rotate relative to the upper and lower eccentric bushes 51 and 52.

When the locking pin 43 contacts the first end 53*a* of the slot 53, the maximum eccentric part of the upper eccentric cam 41 contacts the maximum eccentric part of the upper eccentric bush 51. In this case, the upper eccentric bush 51 rotates while being maximally eccentric from the central axis C1-C1 of the rotating shaft 21. Thus, the upper roller 37 rotates while being in contact with an inner surface of the housing 33 to define the upper compression chamber 31, to execute the compression operation.

Simultaneously, as shown in FIG. 4, the maximum eccentric part of the lower eccentric cam 42 contacts the minimum eccentric part of the lower eccentric bush 52. In this case, the lower eccentric bush 52 rotates while being concentric with the central axis C1-C1 of the rotating shaft 21. Thus, the lower roller 38 rotates while being spaced apart from the inner surface of the housing 33, which defines the lower compression chamber 32, by a predetermined interval, thus the compression operation is not executed.

Therefore, when the rotating shaft 21 rotates in the first direction, the gas refrigerant flowing to the upper compression chamber 31 through the upper inlet port 63 is compressed by the upper roller 37 in the upper compression chamber 31 having a larger capacity, and subsequently is discharged from the upper compression chamber 31 through the upper outlet port 65. On the other hand, the compression operation is not executed in the lower compression chamber 32 having a smaller capacity. Therefore, the rotary compressor is operated in a larger capacity compression mode.

Meanwhile, as shown in FIG. 3, when the upper roller 37 comes into contact with the upper vane 61, the operation of compressing the gas refrigerant is completed and an operation of drawing the gas refrigerant is started. At this time, some of the compressed gas, which was not discharged through the upper outlet port 65, returns to the upper compression chamber 31 and expands again, to apply a pressure to the upper roller 37 and the upper eccentric bush 51 in a rotating direction of the rotating shaft 21.

If upper eccentric bush 51 rotates at a speed faster than the rotating shaft 21, then the upper eccentric bush 51 slips over the upper eccentric cam 41. When the rotating shaft 21 further rotates in such a state, the locking pin 43 collides with the first end 53*a* of the slot 53, so that the upper eccentric bush 51 rotates at a same speed as the rotating shaft 21. At this time, noise may be generated and the locking pin 43 and the slot 53 may be damaged, due to the collision between the locking pin 43 and the slot 53.

When the upper roller 37 comes into contact with the upper vane 61, some of the gas refrigerant returns to the upper compression chamber 31 through the upper outlet port 65 and expands again, to generate a pressure. The pressure acts on the upper eccentric bush 51 in the rotating direction of the rotating shaft 21 which is the first direction, thus the upper eccentric bush 51 may slip over the upper eccentric cam 41. However, in the present invention, the clutch 80 which is set in the through hole 90 of the rotating shaft 21, prevents the upper eccentric bush 51 from rotating faster than the rotating shaft 21, to thereby prevent the upper eccentric bush 51 from slipping over the upper eccentric cam 41.

In a detailed description, as shown in FIG. 5, when the rotating shaft 21 rotates faster than a predetermined speed, the centrifugal force of the rotating shaft 21 exceeds the elastic force of the coil spring 81. Thus, the clutch pin 82 outwardly moves from a position shown by a dotted line to a position shown by a solid line of FIG. 5. Thereby, the locking part 84 of the clutch pin 82 engages with the second end 53*b* of the slot 53, so that the upper eccentric bush 51 rotates at the same speed as the rotating shaft 21, to thereby prevent the upper eccentric bush 51 from slipping.

To make the compression operation in the lower compression chamber 32 after the compression operation has been executed in the upper compression chamber 31 without the slippage of the upper eccentric bush 51 by the eccentric unit 40 and the clutch 80 according to the present invention, the rotating shaft 21 is stopped to change the rotating direction thereof to the second direction. The compression operation executed in the lower compression chamber 32 will be described in the following with reference to FIGS. 6 to 8.

Figure 6:
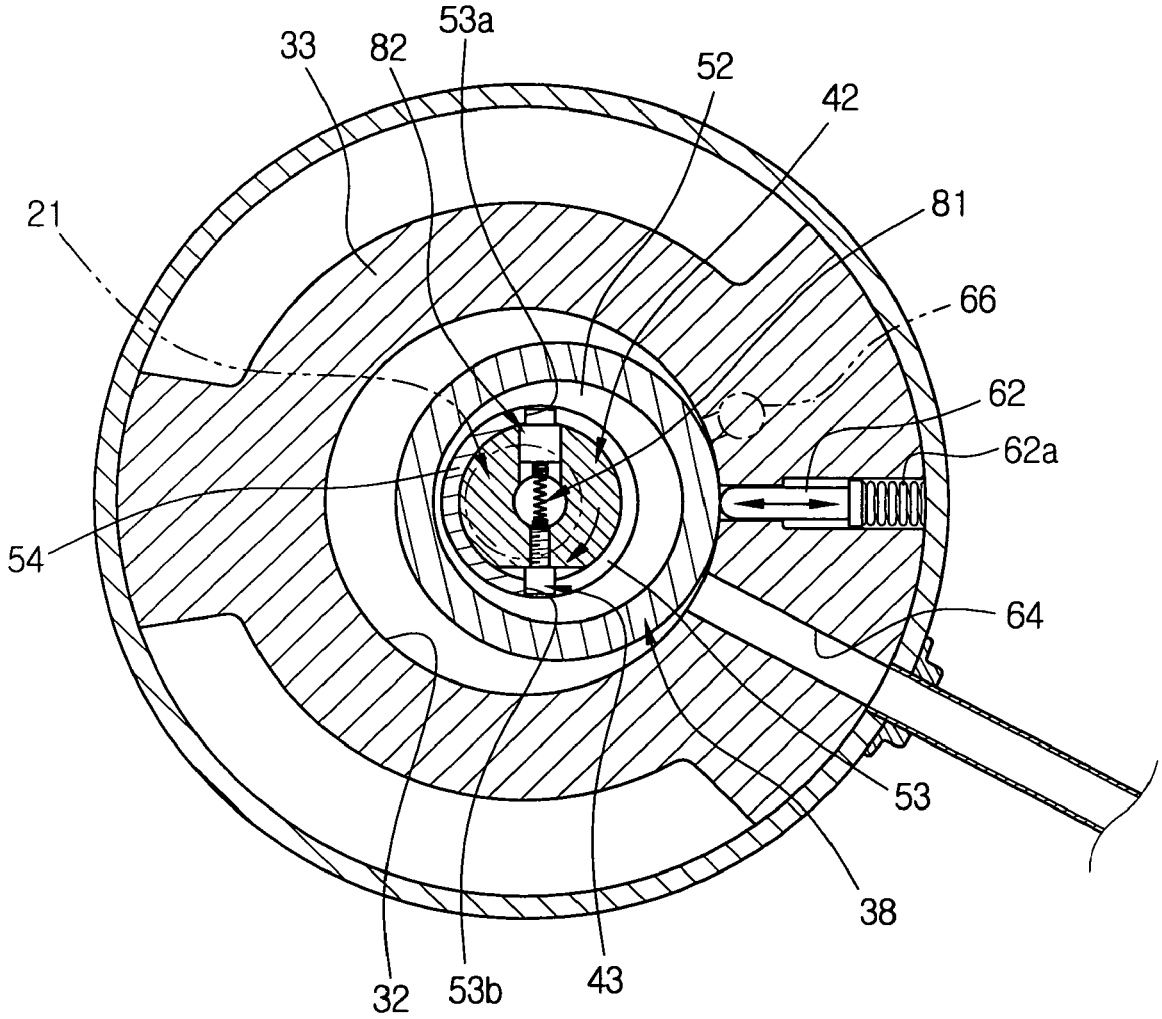
FIG. 6 is a sectional view to illustrate the lower compression chamber where the compression operation is executed by the eccentric unit of FIG. 2, when the rotating shaft rotates in a second direction.
Figure 7:
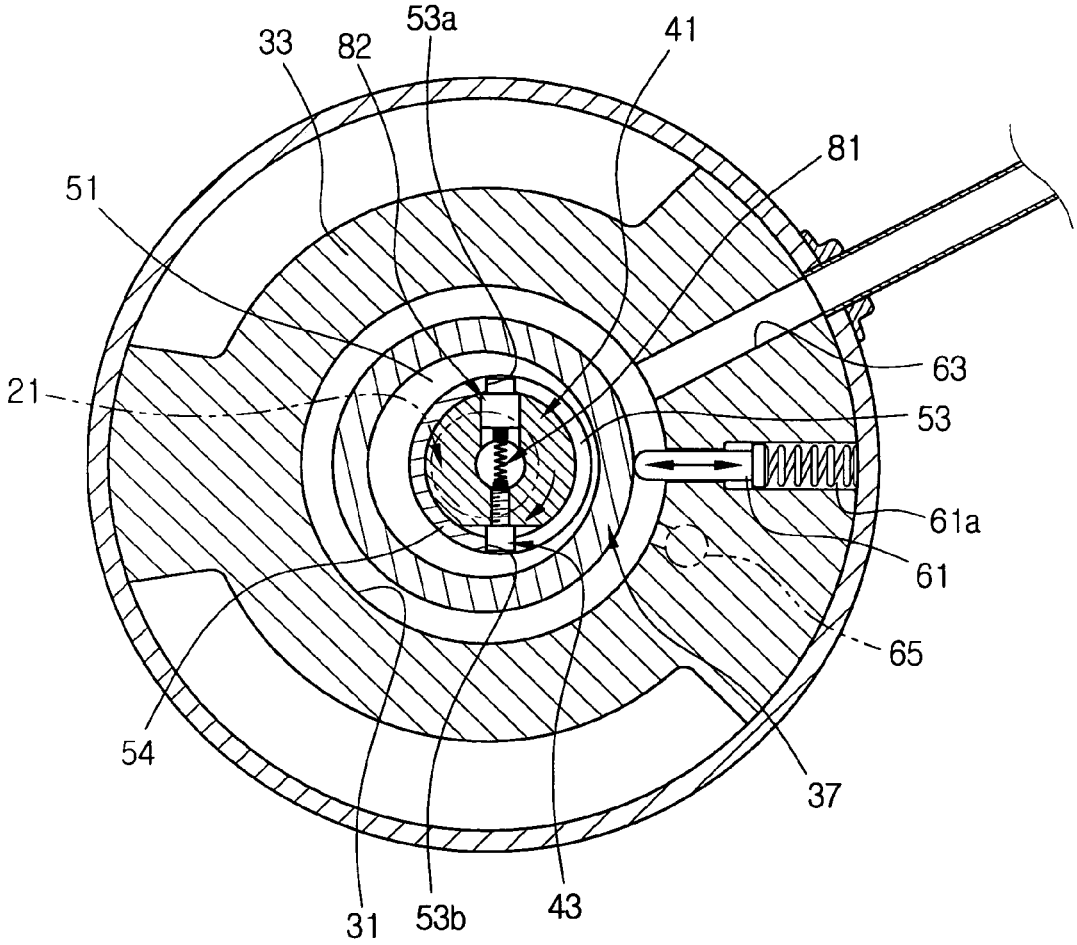
FIG. 7 is a sectional view, corresponding to FIG. 6, to illustrate the upper compression chamber where the idle operation is executed by the eccentric unit of FIG. 2, when the rotating shaft rotates in the second direction.
Figure 8:
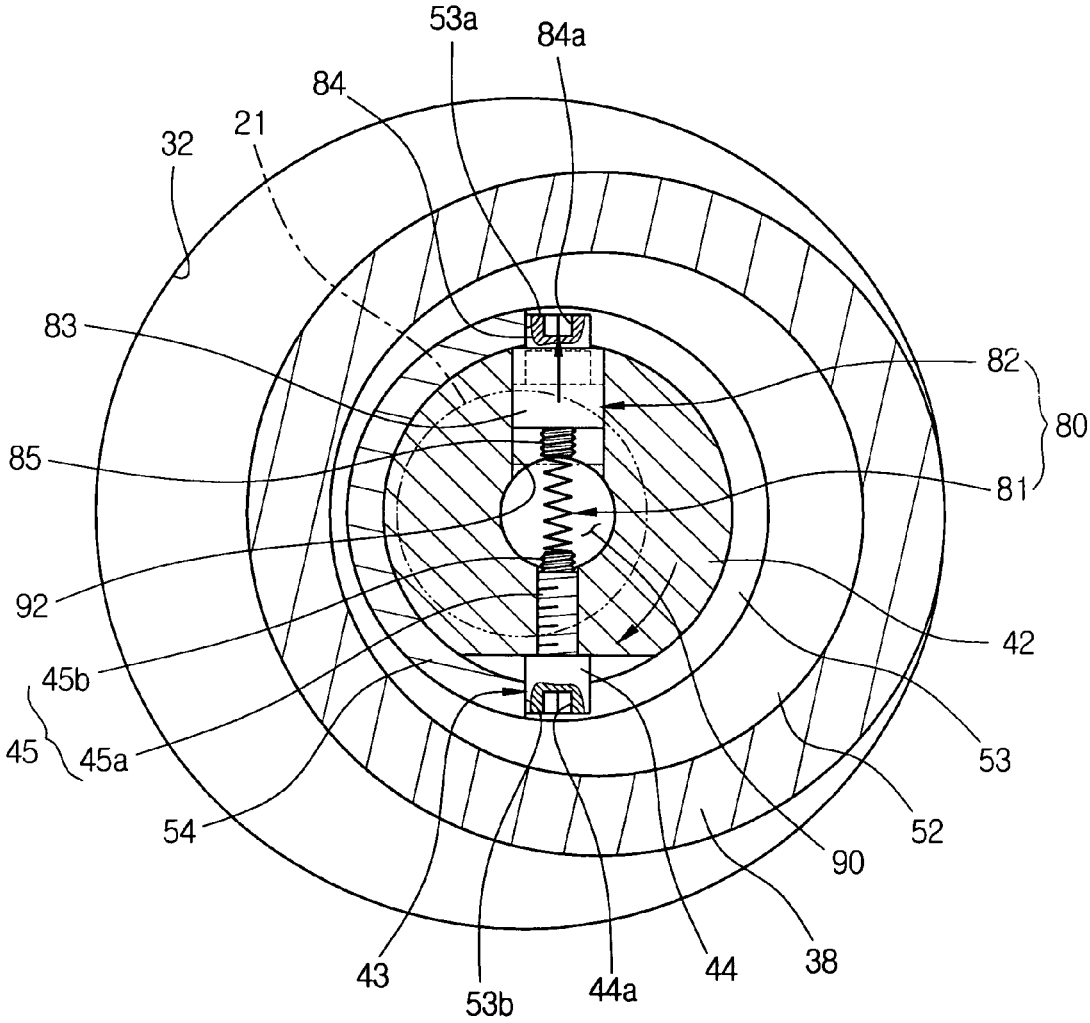
FIG. 8 is a sectional view to illustrate the lower eccentric bush which rotates without the slippage by the clutch unit provided at the predetermined position of the eccentric unit of FIG. 2, when the rotating shaft rotates in the second direction.

FIG. 6 is a sectional view to illustrate the lower compression chamber where the compression operation is executed without the slippage by the eccentric unit of FIG. 2, when the rotating shaft rotates in the second direction. FIG. 7 is a sectional view, corresponding to FIG. 6, to illustrate the upper compression chamber where the idle operation is executed by the eccentric unit of FIG. 2, when the rotating shaft rotates in the second direction. FIG. 8 is a sectional view to illustrate the lower eccentric bush which rotates without the slippage by the clutch of FIG. 2, when the rotating shaft rotates in the second direction.

As shown in FIG. 6, when the rotating shaft 21 rotates in the second direction which is clockwise in FIG. 6, the compression operation is executed in only the lower compression chamber 32, oppositely to the operation of FIGS. 3 and 4 to illustrate the compression operation executed in only the upper compression chamber 31.

When the rotating direction of the rotating shaft 21 is changed to the second direction at a low speed, the clutch pin 82 retracts into the through hole 90 of the rotating shaft 21 by the elastic force of the coil spring 81, and simultaneously the locking pin 43 engages with the second end 53*b* of the slot 53.

In this case, the maximum eccentric part of the lower eccentric cam 42 contacts the maximum eccentric part of the lower eccentric bush 52, thus the lower eccentric bush 52 rotates along with the rotating shaft 21 while being maximally eccentric from the central axis C1-C1 of the rotating shaft 21. Therefore, the lower roller 38 rotates while being in contact with the inner surface of the housing 33 which defines the lower compression chamber 32, to execute the compression operation.

Simultaneously, as shown in FIG. 7, the maximum eccentric part of the upper eccentric cam 41 contacts the minimum eccentric part of the upper eccentric bush 51. In this case, the upper eccentric bush 51 rotates while being concentric with the central axis C1-C1 of the rotating shaft 21. Thus, the upper roller 37 rotates while being spaced apart from the inner surface of the housing 33, which defines the upper compression chamber 31, by a predetermined interval, thus the compression operation is not executed.

Therefore, the gas refrigerant flowing to the lower compression chamber 32 through the lower inlet port 64 is compressed by the lower roller 38 in the lower compression chamber 32 having the smaller capacity, and subsequently is discharged from the lower compression chamber 32 through the lower outlet port 66. On the other hand, the compression operation is not executed in the upper compression chamber 31 having the larger capacity. Therefore, the rotary compressor is operated in a smaller capacity compression mode.

Meanwhile, as shown in FIG. 6, when the lower roller 38 comes into contact with the lower vane 62, the operation of compressing the gas refrigerant is completed and the operation of drawing the gas refrigerant is started. At this time, some of the compressed gas, which was not discharged through the lower outlet port 66, returns to the lower compression chamber 32 and expands again, to apply a pressure to the lower roller 38 and the lower eccentric bush 52 in the rotating direction of the rotating shaft 21. At this time, the lower eccentric bush 52 rotates faster than the rotating shaft 21, to cause the lower eccentric bush 52 to slip over the lower eccentric cam 42.

When the rotating shaft 21 further rotates in such a state, the locking pin 43 collides with the second end 53*b* of the slot 53, so that the lower eccentric bush 52 rotates at the same speed as the rotating shaft 21. At this time, noise may be generated and the locking pin 43 and the slot 53 may be damaged, due to the collision between the locking pin 43 and the slot 53.

However, in the present invention, the clutch 80 is operated in a same manner as the clutch pin 82 of the clutch 80 is locked by the second end 53*b* of the slot 53 by the centrifugal force of the rotating shaft 21 to prevent the upper eccentric bush 51 from slipping, to thereby prevent the slippage and the collision of the lower eccentric bush 52.

In a detailed description, as shown in FIG. 8, when the rotating shaft 21 rotates faster than the predetermined speed in the second direction, the centrifugal force of the rotating shaft 21 exceeds the elastic force of the coil spring 81. Thus, the clutch pin 82 outwardly moves from a position illustrated by a dotted line to a position illustrated by a solid line of FIG. 8. Thereby, the locking part 84 of the clutch pin 82 engages with the first end 53*a* of the slot 53, so that the lower eccentric bush 52 rotates at the same speed as the rotating shaft 21, to thereby prevent the lower eccentric bush 52 from slipping.

According to the present invention, when the rotating shaft 21 rotates in the first or second direction, the clutch 80 allows the upper or lower eccentric bush 51 or 52 to execute the compression operation in the upper or lower compression chamber 31 or 32, without the slippage.

As is apparent from the above description, the present invention provides a variable capacity rotary compressor, which is designed to execute a compression operation in either of upper and lower compression chambers having different capacities by an eccentric unit which rotates in the first or second direction, to vary a compression capacity of the compressor as desired.

Further, the present invention provides a variable capacity rotary compressor which has a clutch provided at a through hole of a rotating shaft, to thereby prevent an upper or lower eccentric bush from slipping even when there exists a variance of pressure in an upper or lower compression chamber during a forward or reverse rotation of an eccentric unit, therefore allowing the upper or lower eccentric bush to smoothly rotate.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A variable capacity rotary compressor, comprising:

upper and lower compression chambers having different capacities;

a rotating shaft passing through the upper and lower compression chambers;

upper and lower eccentric cams provided on the rotating shaft;

upper and lower eccentric bushes fitted over the upper and lower eccentric cams, respectively;

a slot provided at a predetermined position between the upper and lower eccentric bushes;

a locking pin, moving along the slot, to change a position of the upper or lower eccentric bush to a maximum eccentric position; and a clutch to engage with the slot at a position opposite to the locking pin, to prevent the upper and lower eccentric bushes from slipping over the upper and lower eccentric cams, respectively, wherein the rotating shaft comprises a through hole which is provided at a height corresponding to the slot, to allow the locking pin and the clutch to be placed in first and second ends of the through hole, respectively, the clutch comprises a clutch pin set in the second end of the through hole to reciprocate in a radial direction of the rotating shaft and an elastic member provided in the through hole to elastically biasing the clutch pin so that the clutch pin retracts into the through hole when the rotating shaft stops rotating, and the clutch pin comprises a body part having a diameter which is larger than a width of the slot, a locking part projected from an outside end of the body part, and having a diameter which is smaller than the width of the slot, and a first threaded part projected from an inside end of the body part.

2. The variable capacity rotary compressor according to claim 1, wherein the locking pin comprises:

a head to engage with the slot; and a threaded shank extending from the head, and comprising:

a second thread mounted to the first end of the through hole through a screw-type fastening method, to mount the locking pin to the through hole; and a third thread projected from an inside end of the second thread.

3. The variable capacity rotary compressor according to claim 2, wherein the elastic member comprises a coil spring, the coil spring being set in the through hole to be coupled at first and second ends of the coil spring to the first threaded part of the clutch pin and the third thread of the locking pin, respectively.

4. The variable capacity rotary compressor according to claim 3, wherein the head of the locking pin and the locking part of the clutch pin respectively comprise a tightening slot, to allow the first and second ends of the coil spring to be coupled to the first thread of the clutch pin and the third thread of the locking pin, respectively.

5. The variable capacity rotary compressor according to claim 4, wherein the clutch pin and the coil spring are included in the second end of the through hole after the first end of the coil spring is coupled to the first thread of the clutch pin, and the locking pin is included in the first end of the through hole by mounting the second thread of the threaded shank of the locking pin to the first end of the through hole using the tightening slot of the locking pin, and subsequently, the clutch pin is tightened into the second end of the through hole using the tightening slot of the clutch pin, to couple the third thread of the locking pin to the second end of the coil spring, and thereby allowing the clutch pin to be set in the through hole to reciprocate in the radial direction of the rotating shaft by a centrifugal force of the rotating shaft and an elastic force of the coil spring.

6. A variable capacity rotary compressor, comprising:

upper and lower compression chambers having different capacities;

a rotating shaft passing through the upper and lower compression chambers;

upper and lower eccentric cams provided on the rotating shaft to be eccentric from the rotating shaft in a same direction;

upper and lower eccentric bushes fitted over the upper and lower eccentric cams, respectively, to be eccentric from the rotating shaft in opposite directions;

a slot provided at a predetermined position between the upper and lower eccentric bushes;

a locking pin to engage with a first or second end of the slot, according to a rotating direction of the rotating shaft, to change a position of the upper or lower eccentric bush to a maximum eccentric position; and a clutch to engage with the slot at a position opposite to the locking pin, thus preventing the upper and lower eccentric bushes from slipping over the upper and lower eccentric cams, respectively, wherein the locking pin is mounted to a first end of a through hole which is provided at a predetermined position of the rotating shaft between the upper and lower eccentric cams, and the slot is included at the predetermined position between the upper and lower eccentric bushes to receive an outside end of the locking pin therein, and has a length to allow an angle between a first line extending from the first end of the slot to a center of the rotating shaft and a second line extending from the second end of the slot to the center of the rotating shaft to be approximately 180°, the clutch comprises a clutch pin set in a second end of the through hole to reciprocate in a radial direction of the rotating shaft and an elastic member provided in the through hole to elastically biasing the clutch pin so that the clutch pin retracts into the through hole when the rotating shaft stops rotating, and the clutch pin comprises a body part having a diameter which is larger than a width of the slot, a locking part projected from an outside end of the body part, and having a diameter which is smaller than the width of the slot, and a first thread projected from an inside end of the body part.

7. The variable capacity rotary compressor according to claim 6, wherein the locking pin comprises:

a head to engage with the slot; and a threaded shank extending from the head, and comprising:

a second thread mounted to the first end of the through hole through a screw-type fastening method, to mount the locking pin to the through hole; and a third thread projected from an inside end of the second thread.

8. The variable capacity rotary compressor according to claim 7, wherein the elastic member comprises a coil spring, the coil spring being set in the through hole to be coupled at first and second ends of the coil spring to the first thread of the clutch pin and the thread part of the locking pin, respectively, and being extended by a centrifugal force which is generated by a rotation of the rotating shaft so that the clutch pin is projected out of the through hole to make the locking part of the clutch pin be locked by the slot, to thereby prevent the upper or lower eccentric bush from slipping.

* * * * *